United States Patent [19]

Godbersen

[11] 4,343,513

[45] Aug. 10, 1982

[54] METHOD AND POWER TRANSMISSION SYSTEM FOR OPERATING A ROAD PLANAR MACHINE

[75] Inventor: Gary L. Godbersen, Ida Grove, Iowa

[73] Assignee: Gomaco, Inc., Ida Grove, Iowa

[21] Appl. No.: 181,163

[22] Filed: Aug. 25, 1980

[51] Int. Cl.[3] ..... E01C 23/09

[52] U.S. Cl. ..... 299/1; 172/3; 173/8; 173/24; 299/37

[58] Field of Search ..... 299/1, 39; 173/8, 9, 173/24; 37/DIG. 1; 172/3

[56] References Cited

U.S. PATENT DOCUMENTS

| | | | |
|---|---|---|---|
| 3,750,762 | 8/1973 | Eaton | 173/8 |
| 3,888,542 | 6/1975 | Gowler | 299/1 |
| 4,277,898 | 7/1981 | Flippin | 37/DIG. 1 |

*Primary Examiner*—Ernest R. Purser
*Attorney, Agent, or Firm*—Rudolph L. Lowell

[57] ABSTRACT

The method and power transmission system of this invention for driving a road planar machine has the cutter unit in a positive mechanical drive with the drive shaft of a machine power unit through a hydraulically actuated clutch mechanism. The wheel traction units for the machine are continuously driven from the power unit by hydraulic motors operated by variable volume displacement pumps. A control system for retaining the power unit at a set rotational speed required for a predetermined cutting or planing load is responsive to a drop in the set rotational speed, resulting from the cutting unit encountering an overload, to actuate the variable displacement pumps to decrease the forward speed of the machine without appreciably reducing the rotational inertia force of the cutting unit. If the cutting unit overload is of a short duration or momentary the set rotational speed of the power unit is resumed. If the overload, as observed by the machine operator after the occurrence of the drop in the set rotational speed of the power unit, appears to be severe or prolonged, the control system may be manually discontinued and the machine manually controlled until the cutting unit overload has been removed at which time the control system may again be placed into operation.

5 Claims, 8 Drawing Figures

METHOD AND POWER TRANSMISSION SYSTEM FOR OPERATING A ROAD PLANAR MACHINE

BACKGROUND OF THE INVENTION

Planar machines and saw cutting machines for road maintenance work generally drive the cutter heads and saws in a rather conventional manner directly from a power unit or through a hydraulic pump and motor. In U.S. Pat. No. 2,311,891, a road groove cutting tool is directly driven from a separate engine provided for such purpose, through a transmission mechanism and the traction units are driven through a slip-clutch from another engine. Thus, if the cutting tool is held back by road conditions, the clutch will slip to arrest the advance travel of the machine so as to reduce the load on the cutting tool engine. U.S. Pat. No. 2,817,275 discloses a planar machine in which the cutter head is chain and sprocket driven from an engine through a clutch mechanism. The machine is manually propelled so that advancement of the cutter is readily controlled relative to cutting conditions. In the roadway slotting machine of U.S. Pat. No. 3,321,250, the cutter is belt driven from an engine which is also used to drive traction wheels through means including a hydraulic pump to motor to differential arrangement. The road groove cutter in U.S. Pat. No. 3,333,897 is in a direct engine drive connection while in U.S. Pat. No. 4,139,318, the cutter head and traction units are driven in a conventional manner.

In the prior art devices having a belt driven cutter or a cutter having a slip-clutch connection with the power unit, the cutter rotational speed and inertia force are appreciably decreased or stopped when an obstruction is encountered. The cutting operation is thus either stalled or takes place at a slow speed with resultant loss of time and increased expense. Where the advance travel of the machine is continued concurrently with a positive drive of the cutter head as in U.S. Pat. No. 4,139,318, for example, the cutter head is susceptible not only to heavy tooth damage, but also damage to the power unit and/or its drive system.

SUMMARY OF THE INVENTION

The invention provides an improved method and system for driving a road planar machine and a cutter head or unit therefor from a single power unit to remove a top layer of a roadway efficiently and with a minimum of lost time. The rotational speed of the engine is monitored through a control system which, in response to a drop in a set engine rotational speed caused by an overload condition encountered by the cutter head, concurrently slows the advance of the machine, while maintaining a substantially constant inertia force for the cutter head. The cutter head thus continues to operate with full inertia force against the obstructive condition. If the overload condition is removed, the set engine speed is resumed. The planing operation is thus substantially continuous so as to reduce shutdown time and machine damage and maintenance to a minimum without requiring constant observation to road conditions by the machine operator.

DESCRIPTION OF THE INVENTION

Figure 1:
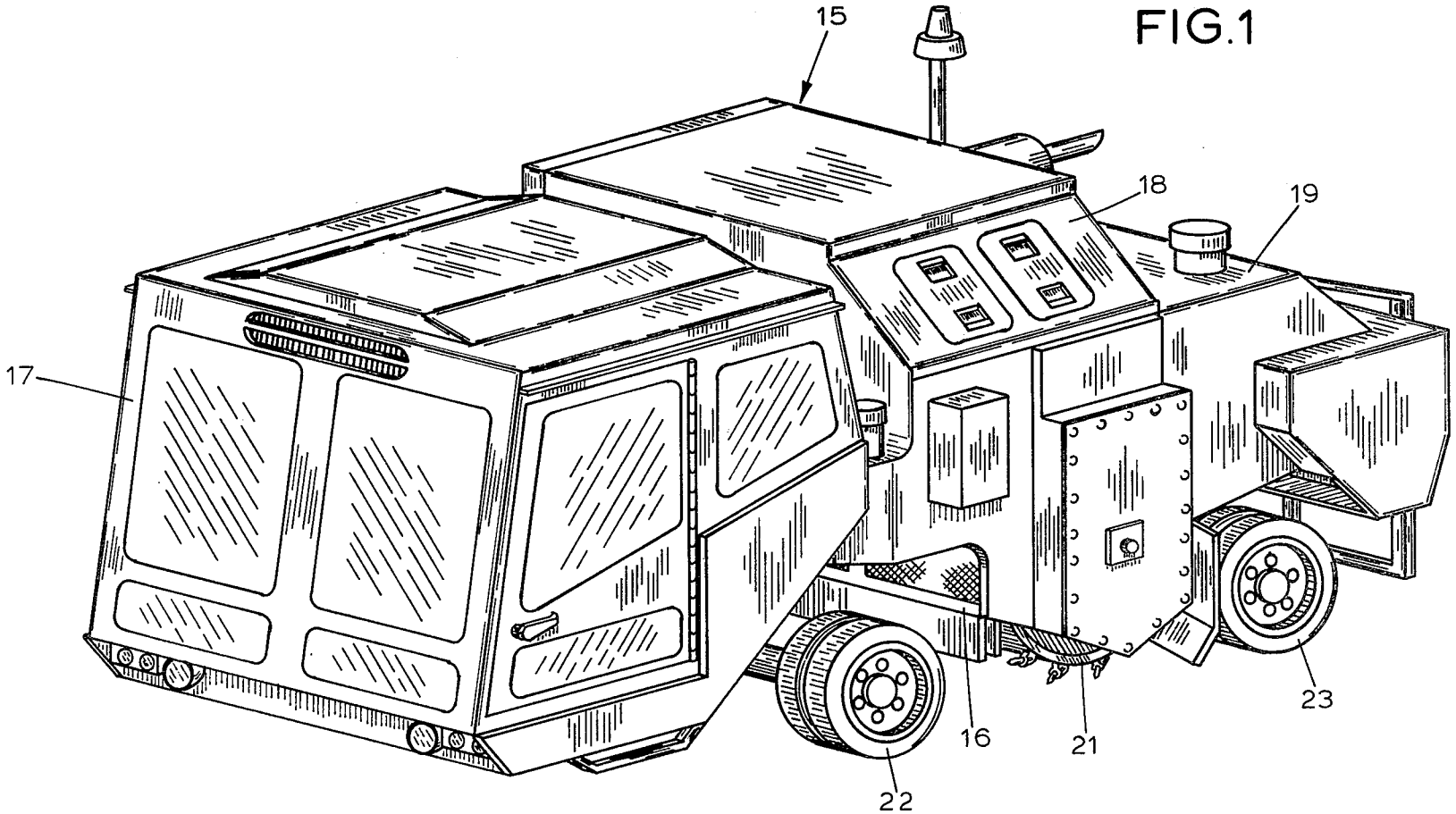
FIG. 1 is a perspective view of the road planar machine which includes the power transmission system of this invention.

Referring to FIG. 1 of the drawings, there is shown a planar type machine 15 for removing a predetermined top layer of a paved road surface, that embodies the power transmission system of this invention. The machine 15 has a main frame or chassis 16 for a front end cab section 17, an intermediate power section 18 and a rear fuel and accessory section 19. A rotary planar or cutting unit 21 is located below the power section 18 and between a pair of front steerable traction wheels 22 and rear traction wheels 23. The various manually operated and controlled actuating elements for operating the machine 15 are conveniently located within the cab section 17.

In machines of this general type, the rotary cutting unit may be driven from a power unit by means including a slip clutch, or by a hydraulic system which includes a bypass or relief valve to prevent damage against any overload imposed on the cutting unit. In either instance, when the cutting unit engages an obstruction, so as to set up an overload condition that exceeds the adjusted setting of the slip clutch or relief valve, the centrifugal inertia force of the rotary cutting unit immediately falls off or is reduced so as to aggravate the imposed load on the cutting unit by effecting a slow down in or a stopping of the road planing operation. This is especially inconvenient and time consuming when the cutting unit is repeatedly forced against the obstruction at variable speeds caused by the erratic or vacillating power delivered to the cutting unit. Additionally, where the cutting unit is hydraulically operated, the repeated operation of a relief valve results in the heating of the oil in the hydraulic system so as to further impede a resumption of normal machine operation.

Where the power unit is in a direct mechanical drive connection with the cutting unit, appreciable damage to the cutting unit or machine may occur when an obstruction is encountered due to the continued advance of the machine into the obstruction with full power applied on the cutting unit. Extreme care and attention to the road surface is therefore required by the machine operator to prevent machine damage and possible personal injury.

To overcome these objections, the power section 18 includes a power unit 24 of diesel engine type which is operatively connected through a flexible coupling 26 (FIG. 4) to a transmission mechanism 27 that has a power take off shaft 28 gear connected in a direct driving relation with the cutting unit 21 through a hydraulically actuated clutch mechanism 31. When the clutch 31 is engaged, the cutting unit 21 is driven directly from the transmission mechanism 27, and in turn from the engine 24, at a reduced rotational speed relative to the rotational speed of the take off shaft 28 through a gear reduction unit 32. The power take off shaft of the gear reduction unit 32 is connected in a one-to-one chain and sprocket drive connection 33 with the cutting unit 21.

Figure 2:
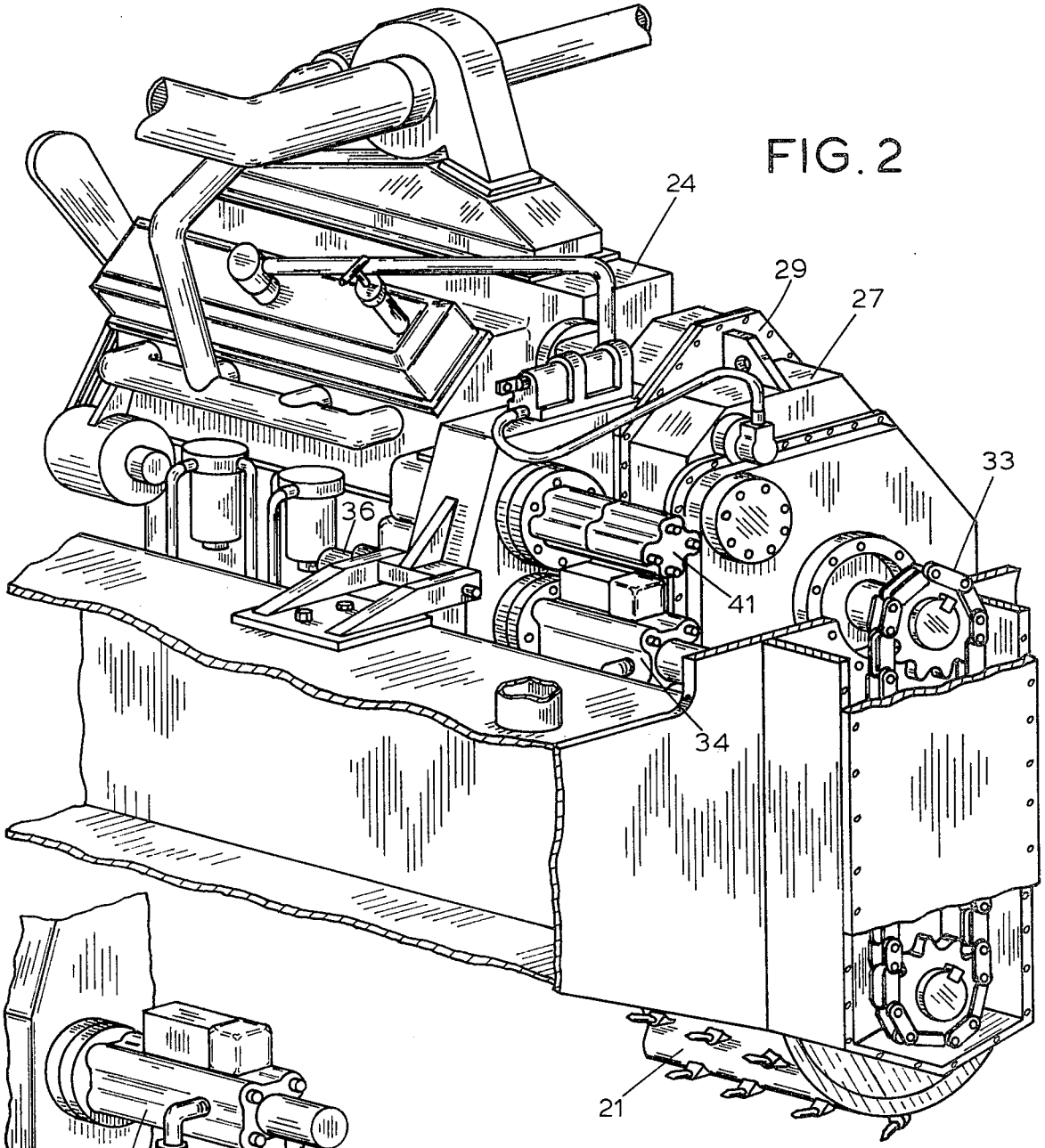
FIG. 2 is an enlarged perspective view of the power unit and transmission system assembly with parts broken away and other parts shown in section for the purpose of clarity.
Figure 3:
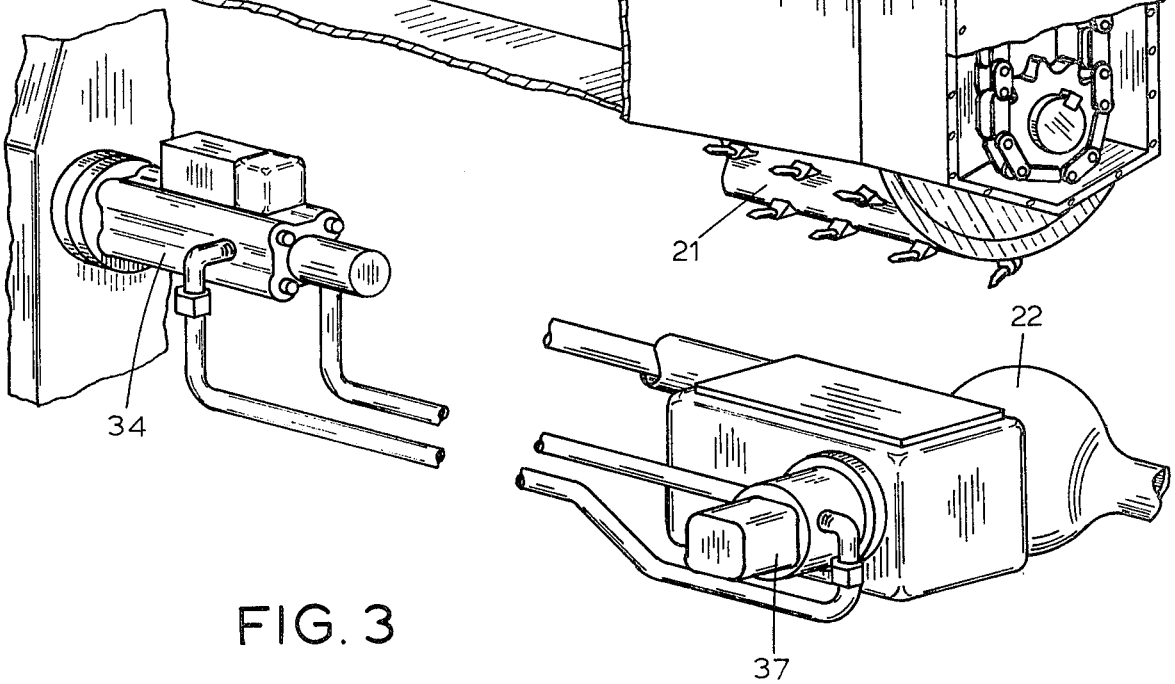
FIG. 3 is a foreshortened detail perspective view showing the assembly of a variable volume displacement pump with an associated drive motor for the machine traction wheels.
Figure 4:
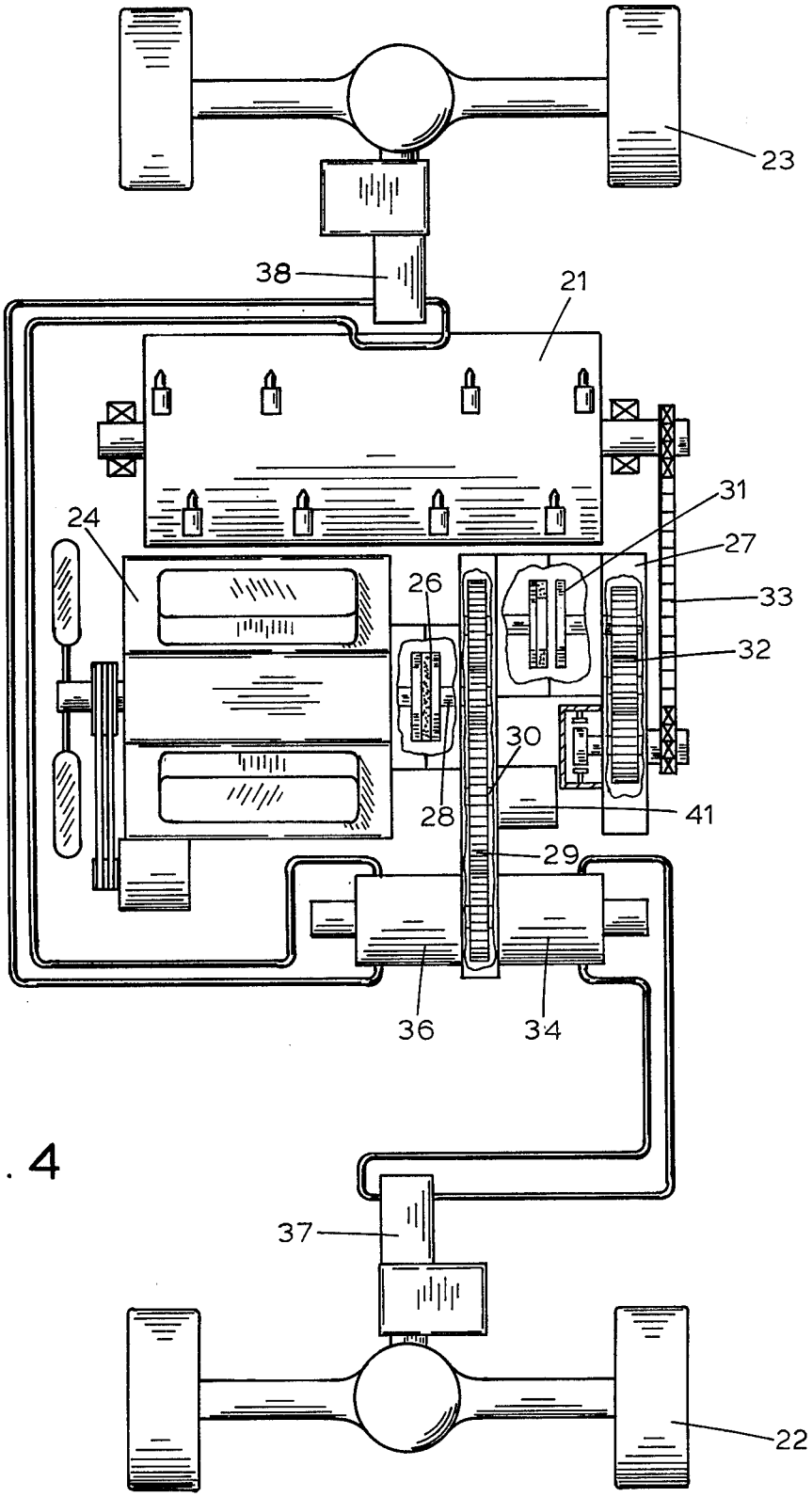
FIG. 4 is a diagrammatic plan view of the transmission system with some parts broken away for clarity.

The power shaft 28 also directly drives through a gear system 29 a pair of variable volume displacement pumps 34 and 36 of like construction, but reversely rotated in operation, having associated hydraulic motors 37 and 38, respectively, for driving the front and rear traction wheels 22 and 23, also respectively (FIGS. 2, 3 and 4). In one embodiment of the invention, the pumps 34 and 36 are heavy duty Sundstrand pumps (Models 20-2065 and 20-2074), available from Sundstrand Hydro-Transmission, Ames, Iowa, a division of Sundstrand Corporation. It is seen, therefore, that when the clutch unit 31 is engaged, the rotational speed of the cutting unit and linear advance of the machine are directly responsive to the rotational speed of the engine power unit 24.

The gear system 29 includes a jack shaft 30 to drive a pump 41 for supplying oil under pressure to the hydraulically actuated components of the machine such as the previously referred to clutch mechanism 31 and, as will later appear, hydro-transmission valves in the variable volume displacement pumps 34 and 36. To automatically retard the advance of the machine 15 concurrently with maintaining the centrifugal inertia force on the cutting unit 21 when there is a drop in the normal operating rotational speed of the engine 24, resulting from an overload condition imposed on the cutting unit, there is provided a constant engine speed control system.

Figure 5:
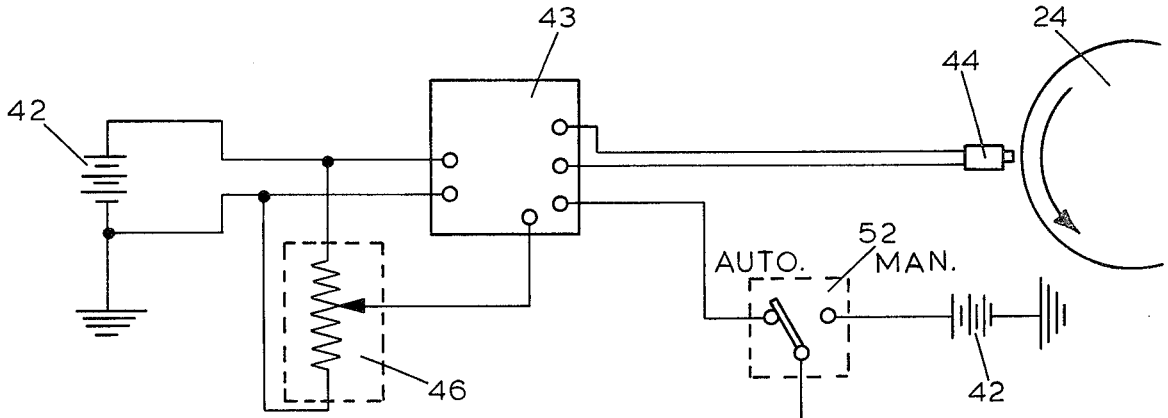
FIG. 5 is a diagrammatic showing of a constant engine speed control system for the power unit of the transmission system.

The constant engine speed control system (FIG. 5) includes a twelve volt battery 42 as the electrical power source. A Honeywell W883 speed control amplifier 43, available from Honeywell, Inc. of Minneapolis, Minnesota, compares the engine speed indicated by a Honeywell SB100A magnetic pulse pickup 44 with a speed set point potentiometer 46 which is set at the normal operating speed of the engine for a normal cutting load on the cutting unit 21. So long as the engine speed is equal to or greater than the speed set point, the output signal from the speed control amplifier 43 is approximately ten volts. This output voltage is used to power a normally manually operated control handle 47 which forms part of the variable volume displacement pumps 34 and 36. This handle 47 operates a hydro-transmission valve 48 on each pump 34 and 36 for actuating a swash plate 49 operatively associated with pistons 51, all of which form part of the commercially available pumps 34 and 36. A position of the control handle 47 generates a variable current signal which drives the hydro-transmission valves 48 to vary the operating angle of the swash plate 49 relative to its axis of rotation, and in turn the volume displacement of the pumps 34 and 36. It is seen, therefore, that with a fixed voltage to power the control handle 47, each handle position defines a specific operating angle of the swash plates 49 and a definite volume displacement by the pumps 34 and 36.

When the engine speed falls below the desired set point speed, due to an overload on the cutting unit 21, the ten volt output signal from the speed control amplifier 43 starts to reduce or drop. This drop in the voltage supply to the control handle 47 results in a corresponding drop in the current to the hydro-transmission valves 48 and a destroking of the swash plates 49, i.e., a reduced stroke of the pistons 51 associated therewith in the variable volume displacement pumps 34 and 36 to reduce the volume of oil supplied to the traction motors 37 and 38, respectively. This operation of the control system acts to concurrently reduce the load on the engine while maintaining the rotational inertia force of the cutting unit 21 to overcome the encountered overload. When the imposed load on the cutting unit has been eliminated, the control system automatically takes over for return of the engine to the set point speed.

Should there occur a failure of the speed control amplifier 43 or the encountering of a cutting unit obstruction greater than can be eliminated by the reduced machine speed, the control system does not provide for a shut down of the machine. In this event, an automanual switch 52 is used to provide for a manual control of the machine from the constant twelve volt battery source. The machine operator merely manipulates the switch 52 from 'automatic' to 'manual' and continues the operation of the machine independently of the speed control system. When normal operation of the machine is to be resumed, the control system is reinstated by returning the switch 52 to its 'automatic' position.

The constant engine speed control system thus functions primarily as a load limiting system which prevents excessive loads being placed on the engine 24. Thus, when the engine speed starts to drop due to excessive loading, the system automatically cuts the load by reducing the advance of the machine and maintaining the rotational inertia of the cutting unit.

Figure 6:
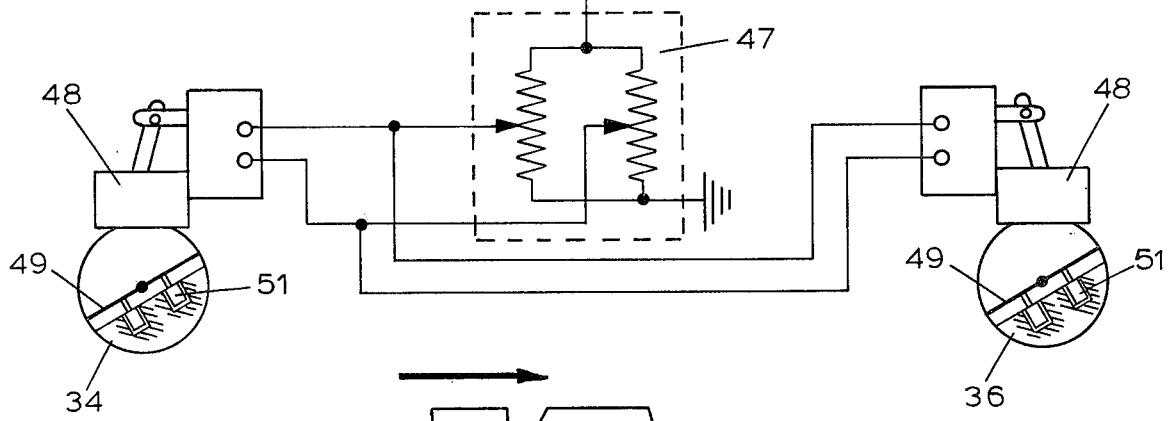
FIGS. 6, 7 and 8 are diagrammatic illustrations, respectively showing, the machine in normal operation; the machine encountering a road obstruction, and the machine returned to normal operation.
Figure 6:
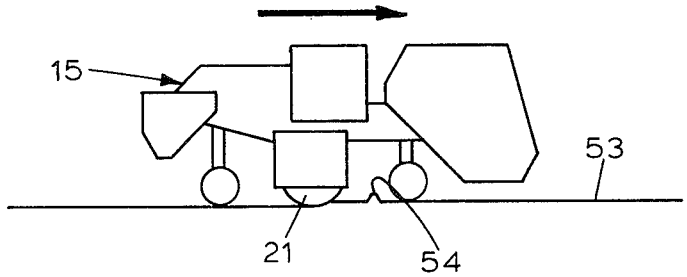
Figure 7:
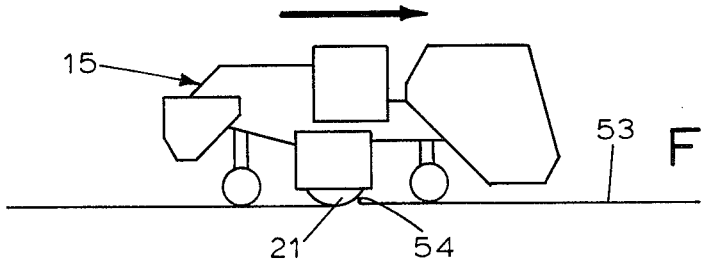
Figure 8:
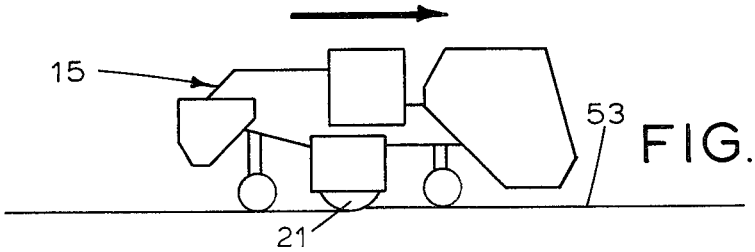

As shown in FIG. 6, the machine 15 is being operated with the cutting unit 21 removing a layer 53 of the roadway and approaching an obstruction 54. During this time the control system is operating with the ten volt output signal from the amplifier 43. On encountering the obstruction 54 (FIG. 7) the engine speed is reduced with a concurrent drop in the voltage to the hydro-transmission valves 48 and reduction in the volume of oil supplied to the traction motors 37 and 38. This slow down operation of the machine continues until the obstruction 54 has been removed, as shown in FIG. 8, at which time normal operation of the machine is resumed.

Although the invention has been described with respect to a preferred embodiment thereof, it is to be understood that it is not to be so limited since changes and modifications can be made therein which are within the full intended scope of this invention as defined by the appended claims.

I claim:

1. A power transmission system for a ground working maching having a rotatable material cutting unit, traction means and a power unit, said system comprising:

(a) a drive shaft for said power unit;

(b) means connecting said cutting unit in a direct gear driven relation with said drive shaft, (c) a variable volume displacement hydraulic pump connected in a direct driven relation with said drive shaft, and having an electrically actuated volume control member, (d) a traction motor for said pump, (e) means connecting the traction means in a driven relation with said traction motor, and (f) an electrical control circuit including means for indicating the rotational speed of the power unit, an adjustable potentiometer unit adjustable to a set rotational speed of the power unit for a normal cutting load, and a rotational speed amplifier for comparing the indicated rotational speed with the set rotational speed to produce a variable output signal for actuating said volume control member;

(g) said rotational speed amplifier responsive to a decrease in the rotational speed set of said power unit to actuate the control member to reduce the volume displacement of said variable volume displacement pump and decrease the linear advance speed of the machine.

2. The power transmission system according to claim 1 wherein:

(a) said cutter unit connecting means includes a hydraulically actuated clutch mechanism.

3. The power transmission system according to claim 1, including:

(a) a speed transmission unit, and (b) means connecting said transmission unit to said drive shaft at a position adjacent the power unit for simultaneously varying the rotational speeds of said variable volume displacement pump and said cutting unit.

4. The method of automatically controlling the load on a single power unit that rotates a rotary cutting unit on a ground working machine and drives the machine traction units, comprising the steps of:

(a) rotating the cutting unit in a direct gear driven relation from the power unit, (b) operating a variable volume displacement pump and associated traction unit in a direct gear driven relation from the power unit, (c) electrically indicating a set rotational speed of the power unit to drive the cutting unit at a predetermined rotational speed and the traction unit at a predetermined road speed, (d) electrically actuating the variable volume displacement pump in direct response to a drop in the indicated set rotational speed of the power unit to simultaneously reduce the road speed of the machine and maintain the rotational inertia force of the cutting unit.

5. The method of claim 4, including the steps of:

(a) manually rendering the set rotational speed inoperative in the event the rotational speed of the power unit drops to a predetermined rotational speed below the set rotational speed, (b) manually controlling the operation of the cutting unit and traction units until the set rotational speed can be resumed, and then (c) manually reinstating the set rotational speed in operation.

* * * * *